US008047404B2

(12) United States Patent
Quinlan et al.

(10) Patent No.: US 8,047,404 B2
(45) Date of Patent: Nov. 1, 2011

(54) BIFURCATED STEM FOAM PUMP

(75) Inventors: Robert L. Quinlan, Stow, OH (US); Mark E. Rosenkranz, Medina, OH (US)

(73) Assignee: GOJO Industries, Inc., Akron, OH (US)

( * ) Notice: Subject to any disclaimer, the term of this patent is extended or adjusted under 35 U.S.C. 154(b) by 705 days.

(21) Appl. No.: 12/069,320

(22) Filed: Feb. 8, 2008

(65) Prior Publication Data

US 2009/0200338 A1 Aug. 13, 2009

(51) Int. Cl.
*A47K 5/14* (2006.01)

(52) U.S. Cl. ..... 222/190; 222/321.9

(58) Field of Classification Search ..... 222/190, 222/321.7, 321.9
See application file for complete search history.

(56) References Cited

U.S. PATENT DOCUMENTS

| | | | | |
|---|---|---|---|---|
| 4,880,161 | A * | 11/1989 | Wright | 222/190 |
| 4,957,218 | A * | 9/1990 | Ford, Jr. | 222/190 |
| 5,222,633 | A * | 6/1993 | Blake | 222/190 |
| 5,372,281 | A | 12/1994 | Palmer et al. | |
| 5,411,177 | A * | 5/1995 | Blake, III | 222/190 |
| 5,445,288 | A * | 8/1995 | Banks | 222/190 |
| 5,752,627 | A | 5/1998 | Vandromme et al. | |
| 5,779,104 | A | 7/1998 | Reidel | |
| 5,984,146 | A * | 11/1999 | Kaufman | 222/190 |
| 6,612,468 | B2 | 9/2003 | Pritchett et al. | |
| 2005/0072805 | A1 * | 4/2005 | Matthews | 222/190 |
| 2006/0273114 | A1 | 12/2006 | Ophardt | |
| 2007/0023454 | A1 * | 2/2007 | Ophardt | 222/190 |
| 2008/0083783 | A1 | 4/2008 | Nelson | |
| 2008/0083784 | A1 * | 4/2008 | Foster et al. | 222/190 |
| 2009/0184137 | A1 * | 7/2009 | O'Brien | 222/190 |

FOREIGN PATENT DOCUMENTS

WO 99/49769 10/1999

OTHER PUBLICATIONS

International Search Report and the Written Opinion from International application No. PCT/US2009/000725, date of mailing May 11, 2009; 12 pages.

* cited by examiner

*Primary Examiner* — Kenneth Bomberg
(74) *Attorney, Agent, or Firm* — Calfee, Halter & Griswold LLP

(57) ABSTRACT

A bifurcated stem foam pump for use in foam dispensers. An air compressor portion of the bifurcated pump is attached to and maintained as a portion of the dispenser housing. A portion of the pump for transferring liquid and including a portion for generating foam is sealingly attached to and provided as a portion of a replaceable liquid-containing cartridge in the foam dispenser. The two portions mate and form a completed pump assembly operative for generating foam from the liquid of the cartridge when the cartridge is placed within the dispenser housing and the two pump portions are mated. The air compressor portion includes a collar having an air piston reciprocatingly received therein. The collar is attached to the dispenser housing. A collar receiving a hollow stem pump is attached to the liquid cartridge. Actuation of the air piston correspondingly actuates the stem pump such that air and liquid are forced together in the stem pump and through a foam generating member.

20 Claims, 4 Drawing Sheets

BIFURCATED STEM FOAM PUMP

TECHNICAL FIELD

The invention herein resides in the art of liquid dispensing mechanisms and, more particularly, to those mechanisms that are particularly adapted for dispensing a liquid in the form of a foam. Specifically, the invention relates to the foam pump generator for such dispensers, and particularly one that is bifurcated or separated between the liquid pump portion and the air pump portion. Specifically the invention relates to a foam pump that allows the liquid pump portion to be fixed to and a part of a sealed disposable refill cartridge containing the liquid, and in which the air pump or compressor is a non-disposable portion of the dispenser housing.

BACKGROUND OF THE INVENTION

For many years, it has been known to dispense liquids, such as soaps, sanitizers, cleansers, disinfectants, and the like from a dispenser housing maintaining a removable and replaceable cartridge containing the liquid. The pump mechanism employed with such dispensers has typically been a liquid pump, simply emitting a predetermined quantity of the liquid upon movement of an actuator. Recently, for purposes of effectiveness and economy, it has become desirable to dispense the liquids in the form of foam, generated by the interjection of air into the liquid, generating the formation of bubbles thereby. Accordingly, the standard liquid pump has given way to a foam generating pump, which necessarily requires means for combining the air and liquid in such a manner as to generate the desired foam. However, foam generating pumps are more expensive than liquid dispensing pumps, necessarily increasing the cost of disposable cartridges that include the pump with each cartridge.

Typically, foam pumps include an air compressor portion and a fluid passing portion—the two requiring communication to ultimately create the foam. The portion required for compressing the air is not given to wear and degradation to the extent of the portion required for passing the liquid and generating the foam from the combination of liquid and air. Accordingly, it has been determined that there is no necessity for replacing the air compressor, but only the liquid pumping and foam generating portion of the pump when replacement of the cartridge is necessary. Accordingly, a bifurcation of the pump has been determined to be possible and desirable, particularly when the portion provided as a part of the replaceable cartridge is sealed to the cartridge in such a way as to maintain its sanitary integrity.

DISCLOSURE OF THE INVENTION

In light of the foregoing, it is a first aspect of the invention to provide a foam pump generator in which the air compression portion is separate and distinct from the liquid passing and foam generating portion.

Another aspect of the invention is the provision of a bifurcated foam pump generator in which the liquid passing and foam generating portion is disposable and replaceable with a liquid cartridge, while the air generator is substantially fixed to the dispenser housing.

Yet another aspect of the invention is the provision of a bifurcated foam pump generator that is cost effective in implementation and capable of producing high quality foam in operation.

Still a further aspect of the invention is the provision of a bifurcated foam pump generator that is readily constructed from state of the art devices and structures, and that is conducive to implementation with presently existing dispensers.

Still a further aspect of the invention is the provision of a bifurcated foam pump generator, having a portion thereof fixed to a housing of a dispenser and the remaining portion thereof being sealed to and a part of a replaceable cartridge, and in which the joinder of the parts is easily effected in the field during cartridge replacement.

The foregoing and other aspects of the invention that will become apparent as the detailed description proceeds are achieved by the improvement of a bifurcated foam pump assembly in a foam dispenser having a housing and an actuator, and receiving a liquid cartridge, the improvement comprising: a foam dispenser having a dispenser housing and an actuator, and receiving a liquid cartridge, the improvement of a bifurcated foam pump assembly, comprising: an air compressor portion attached to the dispenser housing; and a liquid pump portion connected to the liquid cartridge, said liquid pump portion separably mating with said air compressor portion.

Other aspects of the invention which will become apparent herein are achieved by a liquid container for a foam generating dispenser, comprising: a cartridge defining a volume for receiving a liquid; and a liquid pump connected to said cartridge and adapted to mate with an air compressor member to generate foam, said liquid pump comprising reciprocatingly interengaged upper and lower housing members.

BRIEF DESCRIPTION OF DRAWINGS

For a complete understanding of the aspects, structures and techniques of the invention, reference should be made to the following detailed description and accompanying drawings wherein.

BEST MODE FOR CARRYING OUT THE INVENTION

Figure 1:
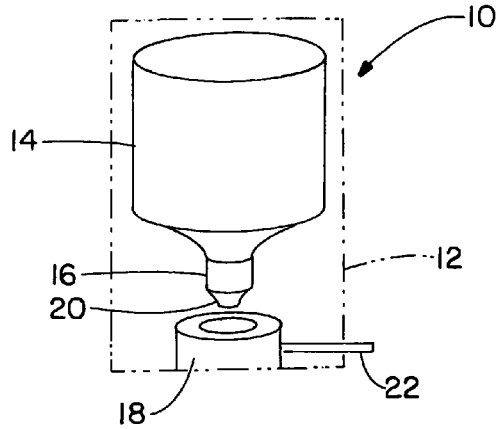
FIG. 1 is an illustrative functional view of a bifurcated stem foam pump made in accordance with the invention.

Referring now to the drawings and more particularly FIG. 1, it can be seen that a foam solution dispenser employing the bifurcated foam pump assembly of the invention is designated generally by the numeral 10. It will be appreciated that the foam solution dispenser may be of any of various types, adapted for dispensing soap, lotion, sanitizers, cleaners or the like in the form of a foam. The dispenser 10 includes a housing 12, typically of molded plastic or the like. The housing 12 defines a cavity which is adapted to receive a bottle or cartridge 14 of liquid of the particular type required for generating the desired foam. The bottle or cartridge 14 is nestingly received by the housing 12 and, as will be readily appreciated by those skilled in the art, is received and contained by supporting brackets, collars and the like within the housing 12.

A liquid pump 16 is sealed to and provided as a portion of the disposable refill cartridge or bottle 14. In contradistinction, an air compressor unit 18 is provided as part and parcel of the dispenser housing 12. In the preferred embodiment of the invention, the liquid pump 16 includes a dispensing nozzle 20, through which the generated foam is dispensed onto the hand of the user, utensil, or otherwise.

A suitable actuator 22, an integral part of the housing 12, is operatively connected to the air compressor 18 to achieve actuation of the foam generator comprising the combination of the liquid pump 16 and air compressor 18. Those skilled in the art will understand that foam is typically generated from a combination of air and liquid, with the two being forced together, agitated, stirred, forcefully blended, or the like. The actuator 22 may be either manually actuated as in the case of a lever, push bar, or the like; or it may be electronically or optically actuated as in the implementation of touch free dispensers.

It will be appreciated that a concept of the invention, and as particularly presented below, is the implementation and utilization of a bifurcated foam pump assembly, in which the liquid pump portion is sealingly attached to and made a portion of the disposable and replaceable cartridge 14, containing the liquid ingredient of the foam solution, while the air compressor 18 and associated nozzle 20 are not disposable, but remain a portion of the dispenser housing 12.

Figure 3:
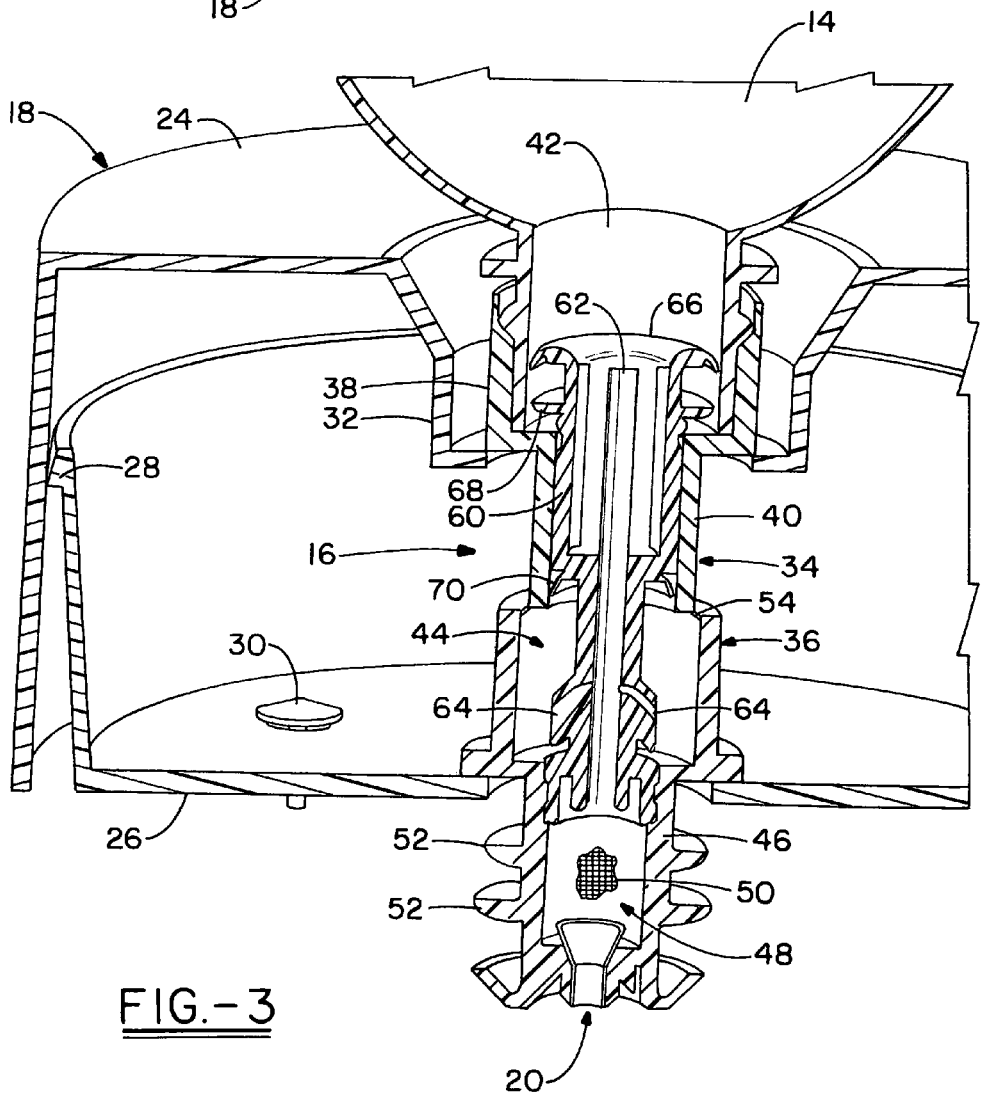
FIG. 3 is a partial sectional view of the foam pump assembly of the invention in the position of FIG. 1, showing the hollow stem in cross section.
Figure 2:
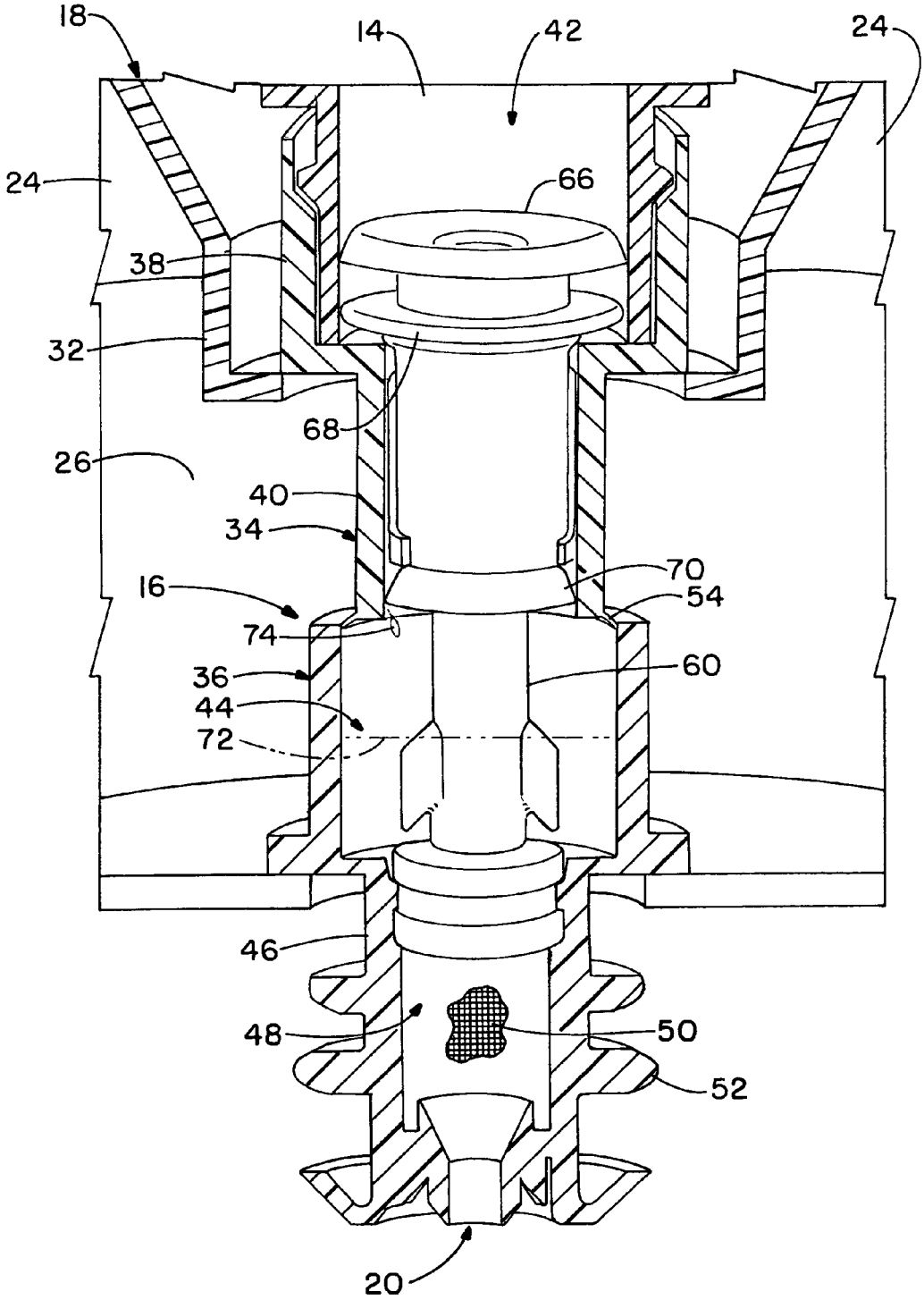
FIG. 2 is a partial sectional view of the foam pump of the invention in the "at rest" position.

Referring now to FIG. 2, it can be seen that the air compressor portion 18 of the invention includes a collar 24 receiving a piston 26 sealingly and reciprocatingly therein. The piston 26 is actuated by the actuator 22, as will be readily apparent to those skilled in the art. A sealing ring 28 extends about an upper edge of the piston 26 in engagement with an interior surface of the cup-shaped collar 18, as best shown in FIG. 3. A one-way check valve 30 is provided in a bottom portion of the piston 26 for purposes of replenishing air within the air chamber defined between the piston 26 and collar 24. Further comprising a portion of the air compressor 18, a collar 32 extends centrally downwardly from the collar 24 and is adapted to receive the bottle or cartridge of liquid 14, having the liquid pump portion 16 of the invention attached thereto.

With continued reference to FIGS. 2 and 3, it can be seen that the liquid pump 16 includes an upper pump housing 34 and a lower pump housing 36, the two being reciprocatingly interengaged as will become apparent below. A collar 38 forms an upper portion of the upper pump housing 34 and is adapted to sealingly engage a neck of the cartridge 14. An upper sleeve portion 40 of the upper pump housing 34 extends downwardly from the collar 38, as shown. The collar 38, in association with the neck of the container 14, defines a first liquid reservoir in communication with the pump.

A second liquid reservoir 44 is defined by the lower pump housing 36 and includes a lower sleeve portion 46 that extends downwardly, ending at the nozzle 20. A cavity 48 is defined within the lower sleeve 46 and is adapted to receive a mesh, screen, sponge or the like 50 for purposes of generating foam from a combination of liquid and air imparted thereto. The sleeve 46 includes a collar 52 adapted for interengagement with the actuator 22. However, it will be appreciated that the actuator 22 may otherwise engage the pump, as will be readily understood by those skilled in the art.

A ring seal 54 extends about the lower end portion of the upper sleeve 40 of the upper pump housing 34, as illustrated. The ring seal 54 engages the inner wall of the lower pump housing 36 defining the second liquid reservoir 44.

A hollow stem 60 is received within and extends between the upper and lower pump housing sections 34, 36. A lower end of the hollow stem 60 is secured to the lower pump housing 36, as shown. The hollow stem 60 includes a central bore 62 that is closed at the top end thereof and that opens into the cavity 48 at the bottom thereof. Feeder passages 64 extend angularly upwardly to provide communication between the second liquid reservoir 44 and the central bore 62 of the hollow stem 60.

An upper ring seal 66 extends about the top end of the hollow stem 60, as shown. The upper ring seal 66 engages the inner wall surfaces of the first liquid reservoir 42 and serves as a wiper or seal between the hollow stem 60 and the walls of the cavity 42. A guide collar 68 extends circumferentially around the hollow stem 60 slightly below the upper ring seal 66 to assure axial alignment within the reservoir 42.

A lower ring seal 70 extends about the hollow stem 60 and within the upper sleeve portion 40, making wiping sealing contacting engagement with the inner wall thereof. As shown in FIG. 2, the second liquid reservoir 44 maintains, in the standby condition, a reservoir of liquid at the level 72, just below the interconnection of the passageway 64 with the central bore 62 of the hollow stem 60. As will be appreciated below, the liquid is moved from the cartridge 14 and first liquid reservoir 42, through the sleeve 40, past the one-way valve lower ring seal 70 and into the second liquid reservoir 44. A liquid droplet 74 is shown in FIG. 2 as passing from the sleeve 40, past the lower ring seal 70 and into the second liquid reservoir 44.

Figure 4:
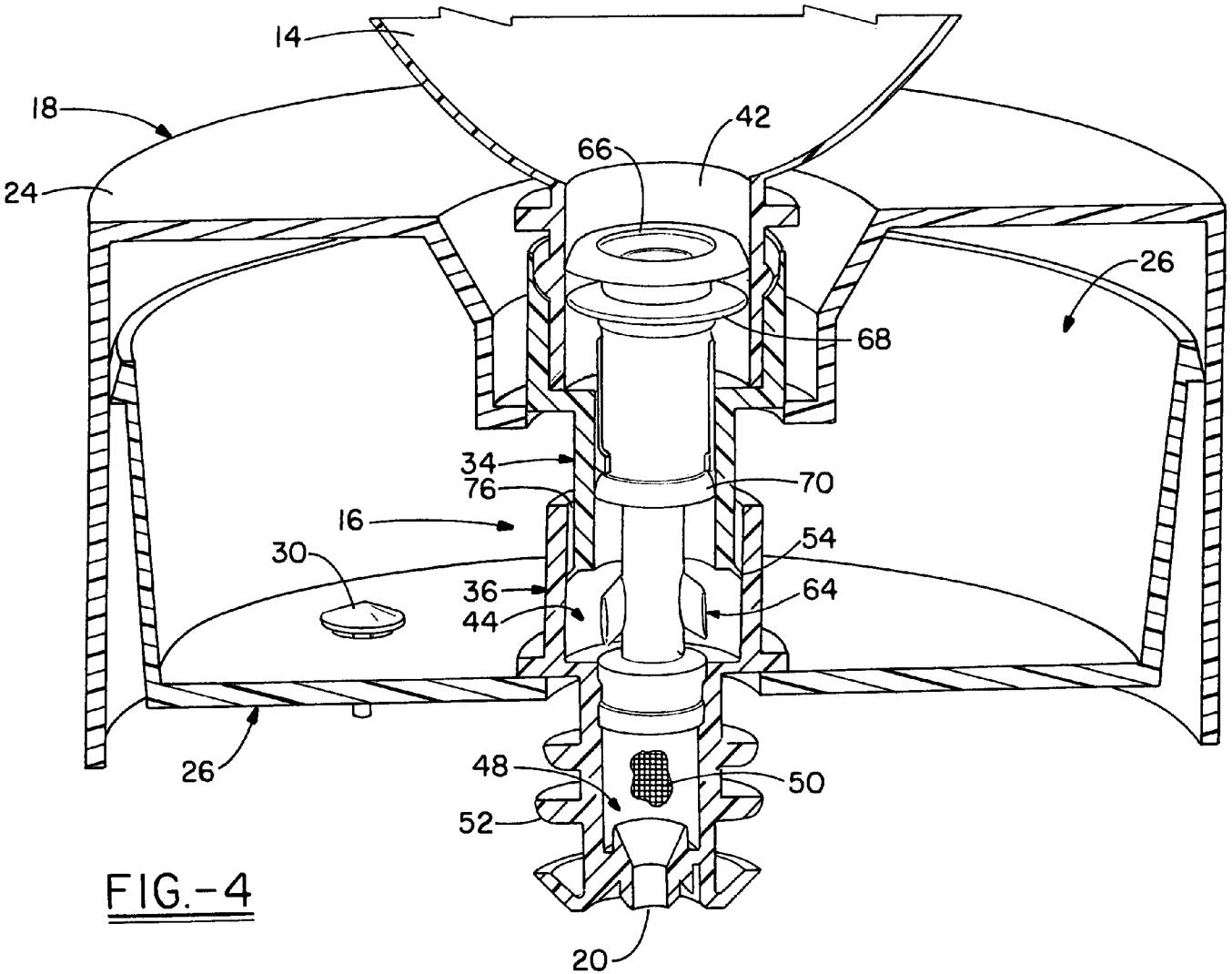
FIG. 4 is a partial sectional view of the stem foam pump structure of the invention, showing the same in a position for foam generation.
Figure 5:
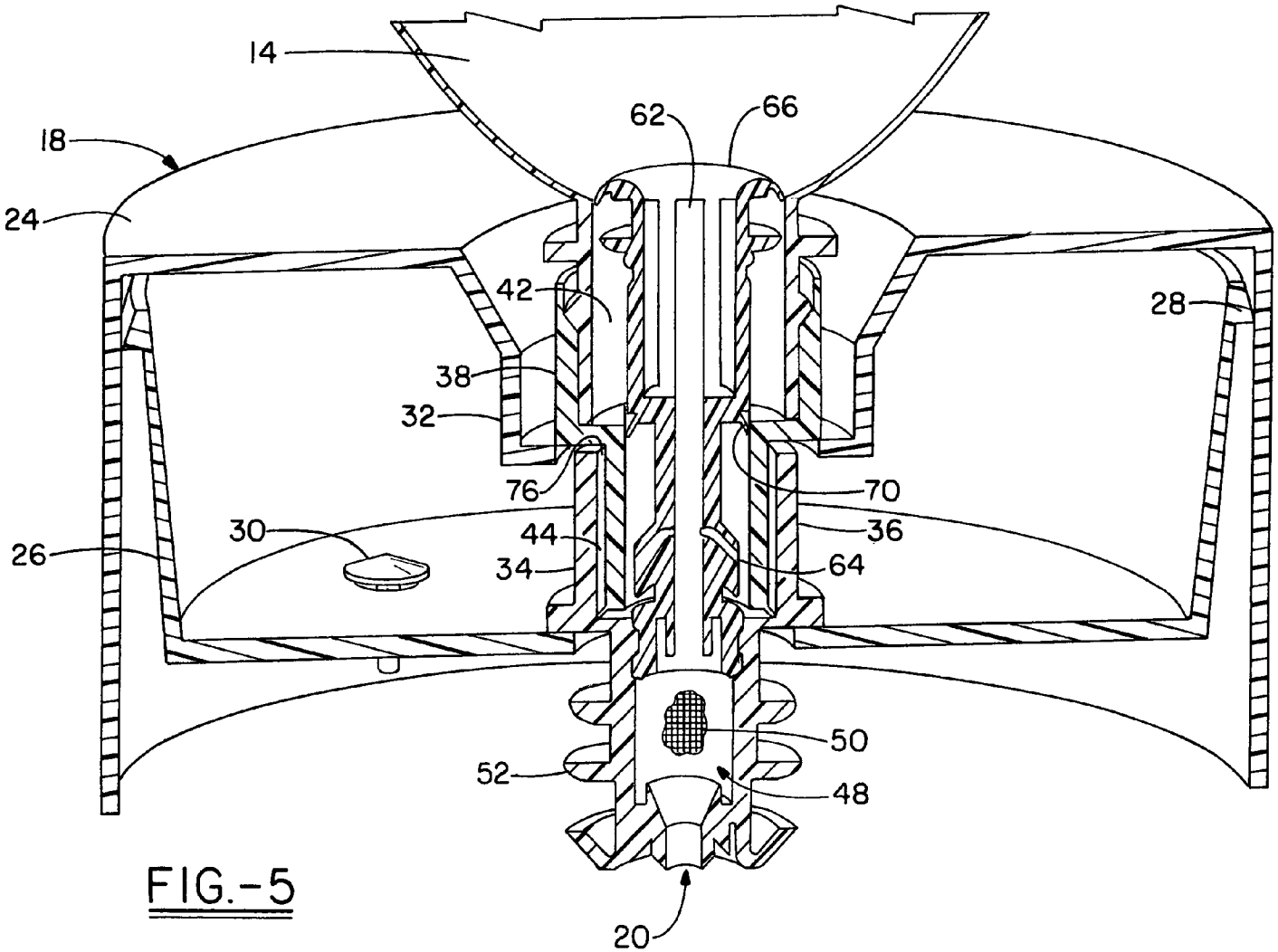
FIG. 5 is a partial sectional view of the stem foam pump of the invention, showing the same in the fully extended activated position.

As best seen in FIGS. 4 and 5, there is a clearance between the sleeve 40 of the upper pump housing 34 and the lower pump housing 36 defining the reservoir 44. This allows for telescoping reciprocating movement between the upper and lower pump housing members 34, 36, and further accommodates the passage of air through the clearance 76 from the air chamber defined between the collar 24 and piston 26 and the second liquid reservoir 44 upon actuation of the pump.

It will be appreciated that a liquid pump portion 16, primarily comprising elements 34, 36 described above, are provided as part and parcel of the replaceable cartridge 14 and is adapted to be received by the air compressor 18, comprising elements 24-32, which are a fixed integral portion of the dispenser housing 12. Of course, appropriate seals are provided on the pump and air compressor mating portions to ensure leak-free operation, as to both liquid and air.

With an appreciation of the structure of the invention, an understanding of its operation can be obtained. FIGS. 2 and 3 illustrate the at-rest or standby position of the dispenser and foam pump assembly of the invention. At this point, a level of liquid 72 is maintained within the second liquid reservoir 44. Upon actuation of the actuator 22, the piston 26 compresses within the collar 24, compressing the air chamber defined therebetween, sealing the one-way check valve 30, and driving air through the clearance 76 between the upper and lower pump housing member 34, 36 and into the second liquid reservoir 44. Accordingly, both liquid and air are driven through the feeder passages 64 and into the central bore 62 of the hollow stem 60. The combination of air and liquid is then forced from the central bore 62 and into the cavity 48 maintaining an appropriate mesh, screen, sponge or the like to extrude the combination of liquid and air into a foam that is emitted from the nozzle 20.

The pump is shown at its maximum compression in FIG. 5. Thereafter, a spring or other appropriate return mechanism that may be either provided interiorly between the collar 24 and piston 26, or as part and partial of the actuator 22, causes return of the pump to its standby position. At the maximum extension shown in FIG. 5, liquid from the cartridge 14 passes by the lifted upper ring seal 60 and into the first liquid reservoir 42. As the return mechanism draws the hollow stem 60 downwardly between the pump housings 34, 36, the liquid within the first liquid reservoir 42 is driven past the lower ring seal 70, serving as a one-way valve. That liquid then replenishes the second liquid reservoir 44 to the level 72 shown in FIG. 2. During this operation, the one-way check valve 30 is opened by the vacuum created in the air chamber cavity between the collar 24 and piston 26, allowing air to replenish the air chamber. The pump is then available for a subsequent dispensing operation.

Thus it can be appreciated the aspects of the invention have been achieved by the structure presented above. The fluid pump of the invention can be a commonly available fluid pump requiring minimal modification. The fluid pump is sealingly fixedly attached to and remains a portion of the disposable liquid cartridge 14. Being a commonly known and readily available liquid pump, the cost of the disposable cartridge 14 is greatly reduced. Moreover, the air compressor portion of the foam generating assembly remains an integral part of the dispenser housing 12, further reducing refill and replacement costs.

While in accordance with the patent statutes only the best mode and preferred embodiment of the invention has been presented and described in detail, the invention is not limited thereto or thereby. Accordingly, for an appreciation of the true scope and breadth of the invention, reference should be made to the following claims.

What is claimed is:

1. A foam pump dispenser comprising:

a housing;

an actuator;

an air compressor portion attached to the dispenser housing; and a liquid pump portion connected to a liquid cartridge, said liquid pump portion separably mating with said air compressor portion;

the liquid pump portion including a fluid reservoir and a one-way sealing member that allows passage of air under pressure to mix with liquid prior to being expelled as a foam from the dispenser, wherein the liquid pump portion and the liquid cartridge portion are removable from the housing without removing the air compressor portion from the housing.

2. The foam pump dispenser according to claim 1, wherein said air compressor comprises an annular collar received by the housing and an air piston received by said collar, said collar and air piston defining an air chamber therebetween.

3. The foam pump dispenser according to claim 2, wherein said liquid pump comprises reciprocatingly interengaged upper and lower housing members.

4. The foam pump dispenser according to claim 3, wherein said liquid pump further comprises a hollow shaft connected to said lower housing member and reciprocatingly movable within said upper housing member.

5. The foam pump dispenser according to claim 4, wherein said upper housing member defines a first liquid reservoir and said lower housing member defines a second liquid reservoir, said hollow shaft having a first sealing ring at a first end thereof reciprocatingly movable in said first liquid reservoir, and wherein said upper and lower housing members are telescopingly engaged at said second liquid reservoir.

6. A foam pump dispenser comprising:

a dispenser housing;

an actuator;

an air compressor portion attached to the dispenser housing;

a liquid pump portion connected to a liquid cartridge, said liquid pump portion separably mating with said air compressor portion;

wherein said air compressor comprises an annular collar received by the housing and an air piston received by said collar;

said collar and air piston defining an air chamber therebetween;

wherein said liquid pump comprises reciprocatingly interengaged upper and lower housing members and a hollow shaft connected to said lower housing member and reciprocatingly movable within said upper housing member;

wherein said upper housing member defines a first liquid reservoir and said lower housing member defines a second liquid reservoir, said hollow shaft having a first sealing ring at a first end thereof reciprocatingly movable in said first liquid reservoir, and wherein said upper and lower housing members are telescopingly engaged at said liquid reservoir; and wherein said upper housing member has a second sealing ring at an end thereof and in engagement within an inner wall of said lower housing member and reciprocatingly moveable within said second liquid reservoir.

7. The foam pump dispenser according to claim 6, wherein said hollow shaft has a third sealing ring thereabout and in engagement with said upper housing member between said upper and lower liquid reservoirs.

8. The foam pump dispenser according to claim 7, wherein said second and third sealing rings comprise one way valves.

9. The foam pump dispenser according to claim 7, wherein said lower housing member maintains a foam generating element between an open end of said hollow tube and a nozzle of said liquid pump.

10. The foam pump dispenser according to claim 9, wherein said air chamber communicates with said second liquid reservoir through said second sealing ring.

11. The foam pump dispenser according to claim 10, wherein said hollow shaft further comprises upwardly angled inlets from said second liquid reservoir.

12. The foam pump dispenser according to claim 11, wherein said piston has a one-way valve for replenishing said air chamber.

13. A disposable liquid container for a foam generating dispenser, comprising:

a cartridge defining a volume for receiving a liquid;

a liquid pump sealingly connected to said cartridge and adapted to mate with an air compressor member attached to a foam generating dispenser to generate foam, said liquid pump comprising reciprocatingly interengaged upper and lower housing members;

wherein said liquid pump and cartridge are configured to be removable from the foam generating dispenser without removing the air compressor.

14. The disposable liquid container for a foam generating dispenser according to claim 13, wherein said liquid pump further comprises a hollow shaft connected to said lower housing member and reciprocatingly moveable with said upper housing member.

15. The disposable liquid container for a foam generating dispenser according to claim 14, wherein said upper housing member defines a first liquid reservoir and said lower housing member defines a second liquid reservoir, said hollow shaft having a first sealing ring at a first end thereof reciprocatingly moveable in said first liquid reservoir, and wherein said upper and lower housing members are telescopingly engaged at said second liquid reservoir.

16. A disposable liquid container for a foam generating dispenser comprising:

a cartridge defining a volume for receiving a liquid;

a liquid pump sealingly connected to said cartridge and adapted to mate with an air compressor member to generate foam, said liquid pump comprising reciprocatingly interengaged upper and lower housing members;

wherein said liquid pump further comprises a hollow shaft connected to said lower housing member and reciprocatingly moveable with said upper housing member;

wherein said upper housing member defines a first liquid reservoir and said lower housing member defines a second liquid reservoir, said hollow shaft having a first sealing ring at a first end thereof reciprocatingly moveable in said first liquid reservoir, and wherein said upper and lower housing members are telescopingly engaged at said second liquid reservoir;

wherein said upper housing member has a second sealing ring at and end thereof in engagement with an inner wall of said lower housing member and reciprocatingly moveable within said liquid reservoir.

17. The disposable liquid container for a foam generating dispenser according to claim 16, wherein said hollow shaft has a third sealing ring thereabout and in engagement with said upper housing member between said upper and lower liquid reservoirs.

18. The disposable liquid container for a foam generating dispenser according to claim 17, wherein said second and third sealing rings comprise one-way valves.

19. The disposable liquid container for a foam generating dispenser according to claim 17, wherein said lower housing member maintains a foam generating element between an open end of said hollow tube and a nozzle of said liquid pump.

20. The disposable liquid container for a foam generating dispenser according to claim 19, wherein said hollow shaft further comprises upwardly angled inlets from said second liquid reservoir.

* * * * *